United States Patent [19]

Webb

[11] 4,180,089

[45] Dec. 25, 1979

[54] THRUST PISTON BIASING MEANS

[75] Inventor: Paul D. Webb, Tioga, Pa.

[73] Assignee: Ingersoll-Rand Company, Woodcliff Lake, N.J.

[21] Appl. No.: 838,074

[22] Filed: Sep. 30, 1977

[51] Int. Cl.[2] ..... G05D 11/00

[52] U.S. Cl. ..... 137/115; 91/468; 418/203

[58] Field of Search ..... 418/203; 137/115, 118, 137/596.12; 91/461, 468, 417 R, 165; 92/134; 251/63

[56] References Cited

U.S. PATENT DOCUMENTS

| | | | |
|---|---|---|---|
| 3,076,477 | 2/1963 | Brandenberg | 91/461 X |
| 3,161,349 | 12/1964 | Schibbye | 418/1 DD X |
| 3,334,705 | 8/1967 | Lam | 137/118 X |
| 3,878,864 | 4/1975 | Schurger | 137/115 X |
| 3,958,495 | 5/1976 | Bernhoft | 91/433 |
| 4,031,966 | 6/1977 | Farrell | 92/134 X |

*Primary Examiner*—Irwin C. Cohen
*Attorney, Agent, or Firm*—Bernard J. Murphy

[57] ABSTRACT

The invention, in an embodiment shown, employs a piston-controlled metering valve to attenuate oil-pressure biasing of a thrust piston as discharge pressure in the gas compressor diminishes, and to increase the biasing as the discharge pressure increases. Discharge pressure of the compressor is impressed on one surface of the valve piston, and compressor oil pressure is addressed to the opposite surface of the piston from the oil pressure line. A shunt line communicates with a valve-metered orifice to bypass oil flow therethrough, from the oil pressure line, upon the compressor discharge diminishing, and the orifice becomes constricted—to impede an oil bypass—upon the compressor discharge increasing. The degree of oil bypassing or shunting from the oil pressure line results in a modulation of the oil line pressure which, in turn, is addressed to the thrust piston.

1 Claim, 3 Drawing Figures

THRUST PISTON BIASING MEANS

It is well known in prior art screw compressors to use thrust pistons to unload the rotor thrust bearings. Such a practice is disclosed, for instance, in U.S. Pat. No. 3,161,349, issued Dec. 15, 1964, to L. B. Schibbye, for "Thrust Balancing". Greater bearing life is realized from this practice, as the thrust piston opposes the axial force acting on the bearing (and produced by the rotor). Hence, the countering axial forces—of the rotor, and the thrust piston—are substantially balanced. As described in U.S. Pat. No. 3,161,349, the thrust piston is biased by oil pressure supplied from the oil pump which provides oil for injection into the compression chamber (for sealing and/or cooling) and for lubrication. A line is connected to the pressured oil supply conduit and communicates with a chamber in which the thrust piston is slidably disposed for contacting engagement with the thrust bearing; hence, the pressured oil addresses the piston with the countering, balancing force.

Clearly, the biasing of the thrust piston should have a correlation with the discharge pressure of the compressor. That is to say, it is desirable to maintain an oil pressure on the thrust piston at a certain $\Delta P$ below discharge pressure. The pressure biasing, it has been determined, should be maintained at approximately twenty (20) psi (1.4 kg/sq. cm) below that discharge pressure. This would provide thrust piston unloading as required as the compressor discharge pressure increases. To control this differential or "tracking" pressure by orifices or line sizes would require close control of dimensional accuracy of the parts, imposing an unwarranted manufacturing expense, and an excessive sales price.

It is an object of this invention to set forth means for controllingly biasing a thrust piston with fluid pressure which will automatically provide thrust piston pressure at a fixed level below the compressor discharge pressure.

Particularly, it is an object of this invention to set forth means for controllingly biasing a thrust piston with fluid pressure comprising a source of fluid under pressure; means for conducting fluid from said source to a thrust piston for fluid-pressure biasing thereof; means coupled to said fluid conducting means operative for attenuating the pressure of said fluid; and means coupled to said pressure-attenuating means for operating the latter.

Figure 1:
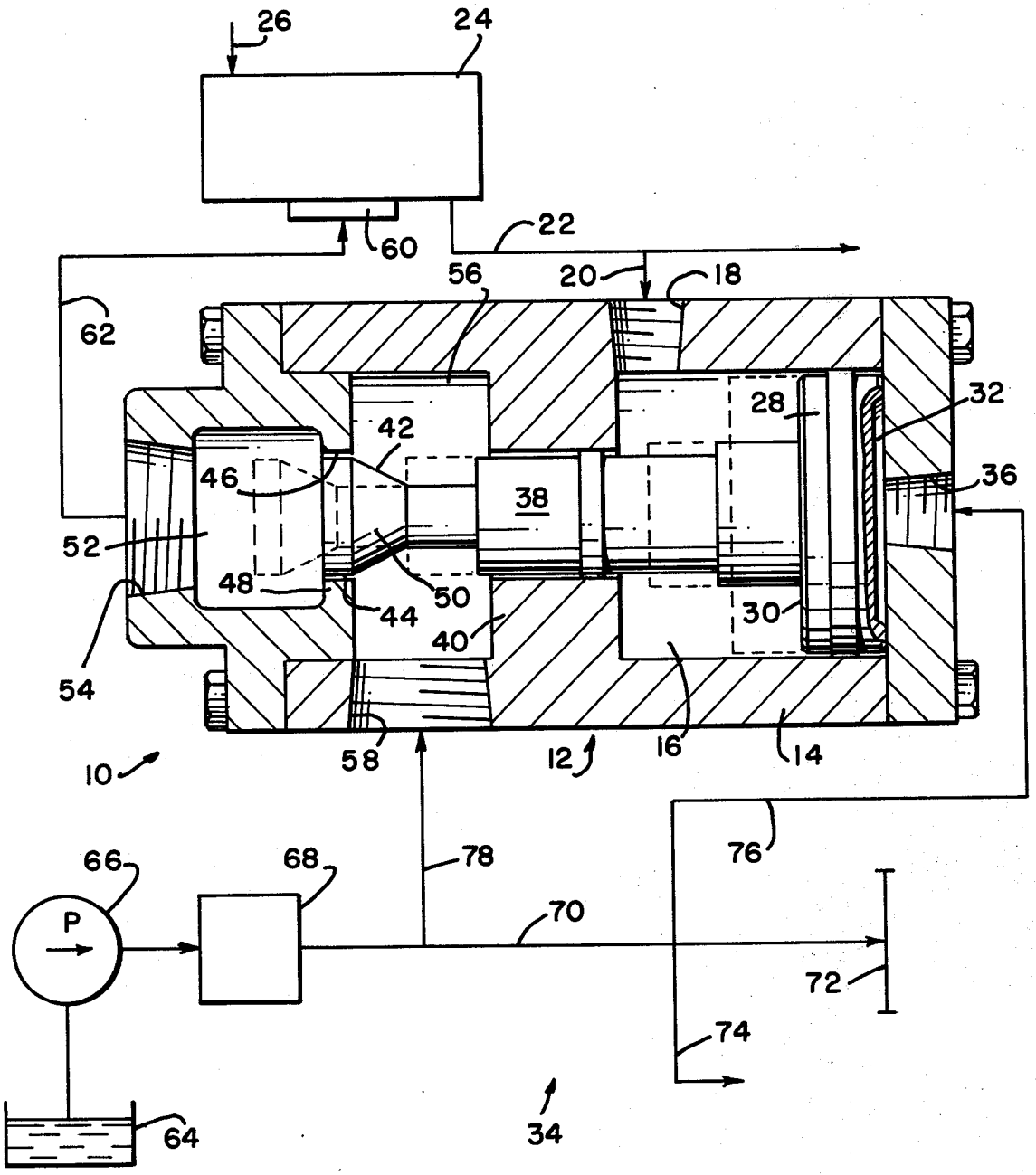
Figure 2:
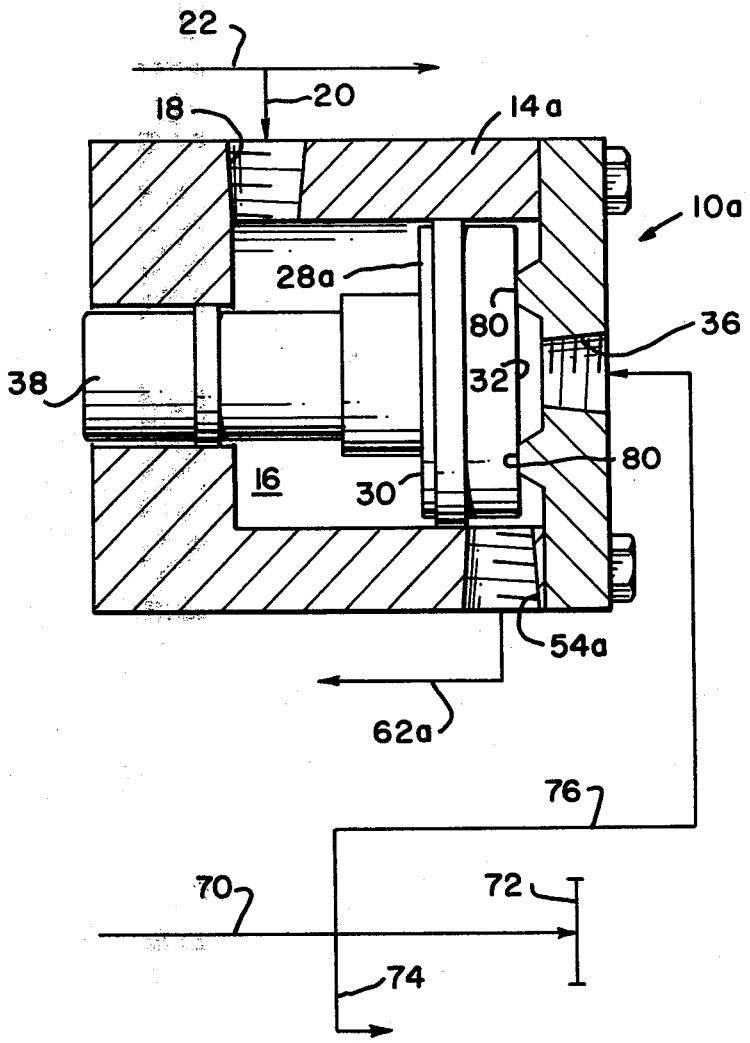
Figure 3:
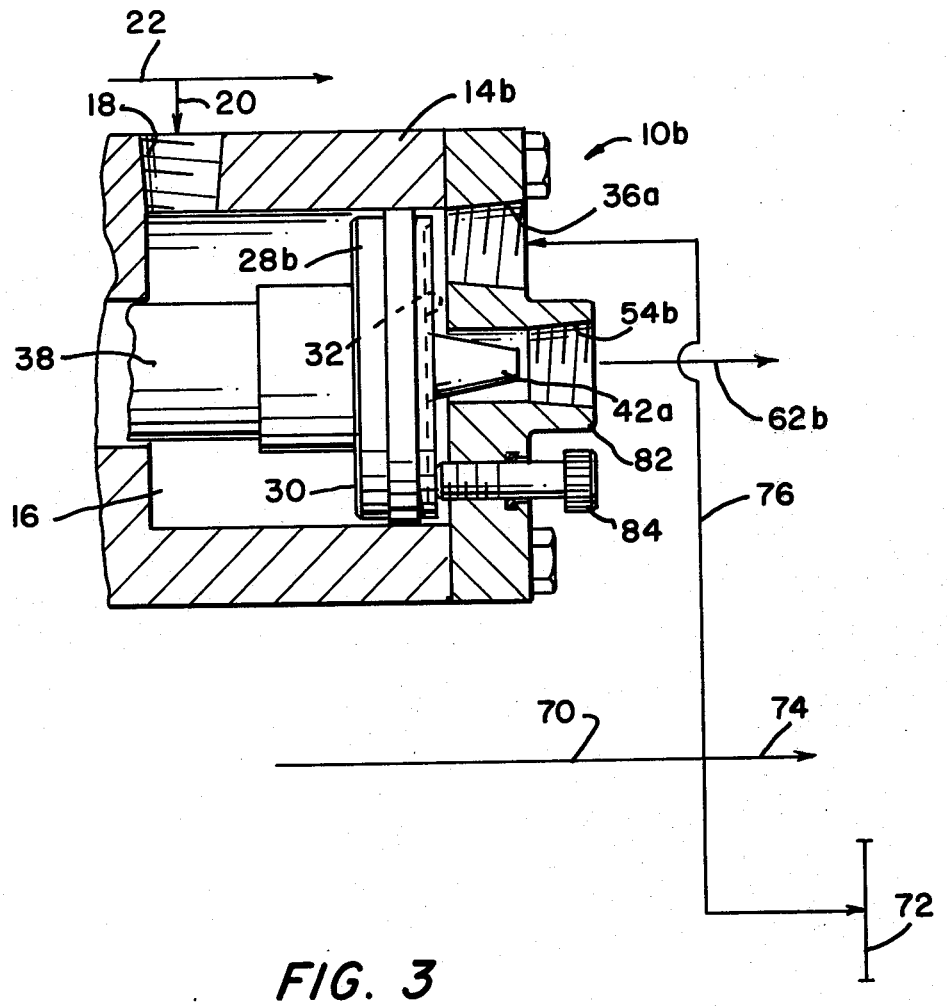

Further objects of this invention, as well as the novel features thereof, will become more apparent by reference to the following description, taken in conjunction with the accompanying Figures in which:

FIG. 1 is a combination schematic/line drawing and pictorial, cross-sectional view of an embodiment of the invention in use with a screw compressor; and FIGS. 2 and 3 are illustrative of alternative embodiments of the invention.

As comprised by the embodiment 10 shown in FIG. 1, the thrust piston biasing means includes a piston-operated control valve 12. Valve 12 comprises a valve body 14 having a cylinder or chamber 16 therewithin. A port 18 opens onto one end of the chamber 16, through the wall of the body 14, and receives thereat a tap off 20 drawn from the discharge line 22 of a screw-type gas compressor 24. The inlet 26 admits gas into the compressor. Chamber 16 has a piston 28 sealingly and slidably disposed therein, piston 28 having a first fluid-impingement surface 30 at one side, and a second fluid-impingement surface 32 at the side opposite. The tap off 20 addresses compressor discharge gas pressures to surface 30, and an oil pressure sub-system 34 supplies a modulated or regulated oil pressure to a port 36—which opens onto the other end of the chamber 16, through the wall of the body 14, for address thereof to piston surface 32.

Piston 28 has a shank or rod 38 which is sealingly and slidably disposed through a first apertured wall 40 in the body 14, and the rod 38 carries a metering element 42. Element 42 has a flat, annular land 44 on its outermost end which defines a close clearance with a complementary land 46 formed in a second apertured wall 48 in the body 14. Adjacent to land 44, element 42 has a tapered surface 50. With translation of piston 28, then, element 42 meters an annular aperture defined either by lands 44 and 46, or by surface 50 and land 46; thus, either a constricted aperture, or an enlarged aperture is presented thereat. Land 46 opens outwardly onto a chamber 52 which, in turn, opens onto a port 54 formed through the wall of the body 14. Land 46 also opens inwardly onto a chamber 56 which, in turn, opens onto a port 58 formed through the wall of the body 14. Ports 58 and 54, then, are communicated for fluid-flow therebetween, through chambers 52 and 56, a fluid flow rate thereof being determined by the positioning of element 42 relative to land 46. Compressor 24 has an oil-injection manifold or gallery 60, and a line 62 communicates the latter with port 54.

The oil pressure sub-system 34 comprises a serially communicating arrangement of an oil reservoir or supply 64, an oil pump 66, and a filter 68. For purposes of clarity, these components are shown independently, yet in practice they could be—and preferably would be—incorporated in the gas compressor 24. An oil pressure supply line 70 supplies biasing pressure to a rotor bearing thrust piston 72; the latter being shown only symbolically, and external of the compressor 24. Thrust piston 72, of course, is actually disposed in the compressor 24—in a constructional arrangement like that set out in the aforementioned U.S. Pat. No. 3,161,349. A pair of lines 74 and 76, communicating with supply line 70, provide oil to the compressor 24 for bearing lubrication, and address oil pressure to port 36, respectively. Finally, another line 78 communicating with port 58 supplies oil to chamber 56.

Assuming the oil pump 66 to be incorporated in the compressor, and driven in common therewith, the operation of the embodiment 10 proceeds as follows. On start up, the piston 28 and metering element 42 are positioned as shown in full-line illustration in the figure. The pump 66 addresses full oil pressure to piston surface 32, and translates the piston 28 to the left (as viewed in the figure). Thus, the orifice defined by land 46 is opened through the resultant translation of element 42. As a consequence, a considerable flow of oil is passed from port 58 to port 54 to gallery 60 (via line 62). Too, line 70 experiences a considerable oil pressure attenuation, due to the shunting of oil through chambers 56 and 52. Therefore, the thrust piston 72 is but lightly biased. As the compressor discharge pressure, addressed to port 18, proceeds to increase, the piston 28 will commence a return toward a right-hand disposition. This causes a throttling or more restricted metering of the orifice of land 46. Hence, oil flow through chambers 56 and 52 diminishes and, as line 78 shunts less oil flow, the pressure in line 70 increases. Thrust piston 72, then, receives an increasing biasing pressure—to counter the growing axial thrust from the rotor(s) of compressor 24.

Upon the compressor 24 achieving full, operating, discharge pressure, the pneumatic and oil pressures operating on surfaces 30 and 32 of piston 28 will substantially stabilize the piston in an intermediate positioning in cylinder 16. Of course, should the tap off 20 present a diminished pressure at port 18, the piston 28 will commence to translate to the left, to open the orifice of land 46, to "depressurize" line 70, and to relieve the biasing of thrust piston 72. Obviously, to over-bias the thrust piston 72 during reduced compressor discharge pressure causes the thrust load to shift from the normally loaded bearing to the reverse thrust bearing and under-pressurizing the thrust piston increases the normally loaded thrust bearing loads. The thrust piston biasing means 10 provides proper thrust piston pressure from one air end to the next and permits larger variations and thrust piston clearances. This permits more practical component tolerances. Accordingly, my invention, as embodied in FIG. 1 as an exemplary structure, provides novel means which "tracks" the compressor discharge pressure, and maintains pressure on the thrust piston 72 at approximately twenty (20) psi (1.4 kg/sq. cm) below the discharge pressure—as the latter goes through pressure level excursions of whatever range.

The FIGS. 2 and 3 alternative embodiments 10*a* and 10*b*, respectively, carry same or similar index numbers, thereby to denote same or similar components and/or structures as depicted in FIG. 1. The thrust piston biasing means 10*a* of FIG. 2 dispenses with the chambers 52 and 56, and metering element 42 (FIG. 1) and, instead, employs piston 28*a* as the metering element. To facilitate this arrangement, body 14*a* has a port 54*a* opening through the wall thereof onto chamber 16 and an oil-injection line 62*a*. In addition, the inner wall of body 14*a* which defines an interface with piston surface 32 has integral "button-type" stand-offs 80 formed thereon to delimit the travel of the piston 28*a* (in the right-hand direction). Patently, the degree to which oil flow through port 54*a* shall be restricted (with piston 28*a* moved fully to the right) is selectively determined by the location of port 54*a*, the extension of stand-offs 80, and the clearance of the head of piston 28*a*.

The thrust piston biasing means 10*b* of FIG. 3 too dispenses with chambers 52 and 56, and metering element 42 of FIG. 1 and, in lieu thereof, carries a metering element 42*a* on the head end of piston 28*b*. Element 42*a* throttles a center port 54*b* formed through a boss 82 of body 14*b*, the port 54*b* having oil-injection line 62*b* in communication therewith. An adjustment screw 84, in sealing penetration of body 14*b*, is employed to delimit the outward travel of piston 28*b*.

While I have described my invention in connection with specific embodiments thereof, it is to be clearly understood that this is done only by way of example, and not as a limitation to the scope of my invention as set forth in the objects thereof and in the appended claims.

I claim:

1. Means for controllingly biasing a thrust piston with oil pressure comprising:

a source of oil under pressure;

means for conducting oil from said source to a thrust piston for pressure biasing thereof;

pneumatic means coupled to said oil conducting means operative for attenuating the pressure of said oil; and means coupled to said pressure-attenuating, pneumatic means for operating the latter; wherein said pressure-attenuating, pneumatic means comprises means for shunting pressured oil away from said oil-conducting means;

said oil-conducting means comprises a first conduit; and said pressure-attenuating, pnuematic means comprises a second conduit communicating with said first conduit for shunting pressured oil away from said first conduit; further including a valve body;

a pair of ports opening into said body;

a passageway, formed in said body, communicating said pair of ports; and a metering element movably disposed in said passageway for opening and constricting said passageway to oil conduct between said pair of ports said metering element being defined by an annular land providing a clearance with said passageway and a tapered surface tapering to its smaller dimension away from said annular land; wherein said second conduit communicates with one port of said pair;

a second pair of ports opening into said body;

a chamber, formed in said body, communicating with said second pair of ports; and a piston element disposed in said chamber for movement between said second pair of ports;

means communicating said source of oil with one of said second pair of ports, to urge said piston element in a first direction to increase the shunting of oil from said oil-conducting means;

a source of modulating pneumatic pressure;

means communicating said pneumatic pressure source with the other port of said second pair thereof, to urge said piston element in a second direction counter to said first direction to decrease the shunting of oil from said oil-conducting means; and means coupling said piston element to said metering element.

* * * * *